US007644511B2

(12) United States Patent
Ishikawa et al.

(10) Patent No.: US 7,644,511 B2
(45) Date of Patent: Jan. 12, 2010

(54) HEATING AND BLOWING APPARATUS

(75) Inventors: Tomoya Ishikawa, Hikone (JP); Hideki Tanaka, Hikone (JP); Kenji Kamada, Hikone (JP); Kazumi Okawa, Hikone (JP); Fumio Mihara, Kyoto (JP)

(73) Assignee: Matsushita Electric Works, Ltd., Osaka (JP)

( * ) Notice: Subject to any disclaimer, the term of this patent is extended or adjusted under 35 U.S.C. 154(b) by 99 days.

(21) Appl. No.: 11/819,354

(22) Filed: Jun. 27, 2007

(65) Prior Publication Data

US 2008/0000101 A1 Jan. 3, 2008

(30) Foreign Application Priority Data

Jun. 30, 2006 (JP) ..... 2006-182466

(51) Int. Cl.
*F26B 25/00* (2006.01)

(52) U.S. Cl. ..... 34/78; 34/90; 34/96; 392/384; 132/220; 361/213

(58) Field of Classification Search ..... 34/78, 34/90, 96; 392/384; 132/220; 361/213; 239/690

See application file for complete search history.

(56) References Cited

U.S. PATENT DOCUMENTS 1,743,963 A * 1/1930 Edmund ..... 34/98
1,787,251 A * 12/1930 Jancke et al. ..... 34/99
1,993,244 A * 3/1935 Martin ..... 34/535
2,026,942 A * 1/1936 Kelley ..... 34/87
2,281,993 A * 5/1942 Charles ..... 34/553
2,846,777 A * 8/1958 Collins ..... 34/95.1
3,289,679 A * 12/1966 Zellerman ..... 132/208
3,335,503 A * 8/1967 Genger ..... 34/100
3,947,659 A * 3/1976 Ono ..... 392/404
5,805,406 A * 9/1998 Mailand ..... 361/212
6,393,718 B1 * 5/2002 Harris et al. ..... 34/96
6,640,049 B1 * 10/2003 Lee et al. ..... 392/385
6,672,315 B2 * 1/2004 Taylor et al. ..... 132/116
6,701,637 B2 * 3/2004 Lindsay et al. ..... 34/71
6,725,562 B2 * 4/2004 Nakagawa et al. ..... 34/96
6,763,606 B2 * 7/2004 Saida ..... 34/97
6,792,692 B1 * 9/2004 Takizawa et al. ..... 34/96
6,895,686 B1 * 5/2005 Sabbatini ..... 34/96

(Continued)

FOREIGN PATENT DOCUMENTS

CN 1438845 8/2003

(Continued)

*Primary Examiner*—Stephen M. Gravini
(74) *Attorney, Agent, or Firm*—Bacon & Thomas, PLLC

(57) ABSTRACT

A heating and blowing apparatus includes a main body housing having an inlet port and a discharge port. An air flow path extends from the inlet pod to the discharge port. A rotatingly driven fan and a heating unit are arranged on the air flow path. A bypass flow path branches off from the air flow path and leads to an ion emission port. An ion generator including a discharge electrode and an opposing electrode is arranged in the bypass flow path Further, the apparatus includes a cover arranged at the ion emission port and having an opening through which ions pass. One or more protrusions are provided on a rear surface of the cover. The protrusions make contact with the opposing electrode such that the cover is grounded through the opposing electrode.

6 Claims, 5 Drawing Sheets

U.S. PATENT DOCUMENTS

| | | | | |
|---|---|---|---|---|
| 6,910,281 | B2 * | 6/2005 | Ito | 34/96 |
| 6,986,212 | B2 * | 1/2006 | Saida et al. | 34/98 |
| 6,996,916 | B2 * | 2/2006 | Cafaro | 34/96 |
| 7,047,660 | B2 * | 5/2006 | Leventhal | 34/97 |
| 7,123,823 | B2 * | 10/2006 | Ceva | 392/385 |
| 7,165,341 | B2 * | 1/2007 | Saida et al. | 34/98 |
| 2002/0189128 | A1 * | 12/2002 | Nakagawa et al. | 34/96 |
| 2003/0033726 | A1 * | 2/2003 | Saida | 34/96 |
| 2003/0152373 | A1 * | 8/2003 | Wong et al. | 392/385 |
| 2004/0020070 | A1 * | 2/2004 | Ito | 34/96 |
| 2004/0172847 | A1 * | 9/2004 | Saida et al. | 34/96 |
| 2005/0097770 | A1 * | 5/2005 | Sabbatini | 34/96 |
| 2005/0108889 | A1 * | 5/2005 | Leventhal | 34/96 |
| 2005/0198853 | A1 * | 9/2005 | Cafaro | 34/96 |
| 2005/0198855 | A1 * | 9/2005 | Cafaro et al. | 34/97 |
| 2005/0229425 | A1 * | 10/2005 | Kroll et al. | 34/283 |
| 2005/0284495 | A1 * | 12/2005 | Yasuda et al. | 132/272 |
| 2006/0026858 | A1 * | 2/2006 | Saida et al. | 34/96 |
| 2006/0032077 | A1 * | 2/2006 | Cafaro | 34/96 |
| 2006/0070255 | A1 * | 4/2006 | Kokuo et al. | 34/96 |
| 2006/0174507 | A1 * | 8/2006 | Lin | 34/96 |
| 2006/0196075 | A1 * | 9/2006 | Santhouse et al. | 34/96 |
| 2006/0201016 | A1 * | 9/2006 | Nakagawa et al. | 34/96 |
| 2006/0232908 | A1 * | 10/2006 | Izumi et al. | 361/220 |
| 2007/0006478 | A1 * | 1/2007 | Kotsuji | 34/96 |
| 2007/0169369 | A1 * | 7/2007 | Lok et al. | 34/97 |
| 2007/0204477 | A1 * | 9/2007 | Lin | 34/96 |
| 2007/0220773 | A1 * | 9/2007 | Evanyk et al. | 34/96 |
| 2008/0216339 | A1 * | 9/2008 | Gray | 34/97 |
| 2008/0229606 | A1 * | 9/2008 | Hirai et al. | 34/97 |
| 2008/0235980 | A1 * | 10/2008 | Chasen et al. | 34/91 |

FOREIGN PATENT DOCUMENTS

| | | |
|---|---|---|
| JP | 2005-185864 | 7/2005 |
| JP | 2005-304961 | 11/2005 |
| WO | WO 2005/102101 | 11/2005 |

* cited by examiner

HEATING AND BLOWING APPARATUS

FIELD OF THE INVENTION

The present invention relates to a heating and blowing apparatus such as a hair dryer, a hot air blower or the like.

BACKGROUND OF THE INVENTION

A heating and blowing apparatus such as a hair dryer, a hot air blower or the like is design to draw air from an inlet port and force the air toward a discharge port by means of a rotating fan. In such an apparatus, a heating unit is arranged on an internal air flow path and the air heated by the heating unit is discharged through the discharge port.

In case of a heating and blowing apparatus having a negative ion generator, a bypass flow path that allows air to be discharged to the outside without passing through a heating unit is provided on the air flow path leading from an inlet port to a discharge port. The presence of the bypass flow path is to avoid restraining an ion passage amount, which would otherwise be caused by a lattice-shaped member arranged at the discharge port. The ion generator is arranged on the bypass flow path (see, e.g., Japanese Patent Laid-open Application No. 2002-191426).

Since a high voltage portion is present in the ion generator, it is required for safety to block fingers from contacting with the ion generator. Therefore, a cover is normally provided at an ion emission port through which negative ions generated by the negative ion generator are discharged. However, despite the provision of the bypass flow path for passage of the ions, the cover made of an insulating material is electrified by the ions generated in the ion generator, thereby causing the ion passage amount to decrease.

SUMMARY OF THE INVENTION

It is, therefore, an object of the present invention to provide a heating and blowing apparatus that is capable of efficiently discharging ions while assuring safety.

In accordance with the present invention, there is provided a heating and blowing apparatus including a main body housing having an inlet port and a discharge port; a rotatingly driven fan and a heating unit arranged on an air flow path, the air flow path extending from the inlet port to the discharge port; and an ion generator including a discharge electrode and an opposing electrode arranged in a bypass flow path, the bypass flow path branching off from the air flow path and leading to an ion emission port; and a cover, arranged at the ion emission port, having an opening through which ions pass and one or more protrusions provided on a rear surface of the cover, the protrusion making contact with the opposing electrode placed closer to the cover than the discharge electrode is, wherein the cover is grounded through the opposing electrode.

The heating and blowing apparatus may further include a biasing unit for pressing the ion generator toward the protrusion of the cover. This configuration makes it possible to attain a highly stable grounding condition.

In accordance with the present invention, safety is assured by the presence of a cover and there is no likelihood of electrifying the cover and restricting discharge of ions, which helps to discharge the ions in an increased amount. Furthermore, owing to the fact that electric grounding is rendered by use of opposite electrodes of an ion generator, there is no need to employ a separate grounding line.

BRIEF DESCRIPTION OF THE DRAWINGS

The above and other objects and features of the present invention will become apparent from the following description of embodiment given in conjunction with the accompanying drawings, in which.

DETAILED DESCRIPTION OF THE EMBODIMENT

Hereinafter, the present invention will be described based on embodiment shown in the accompanying drawings.

Figure 1:
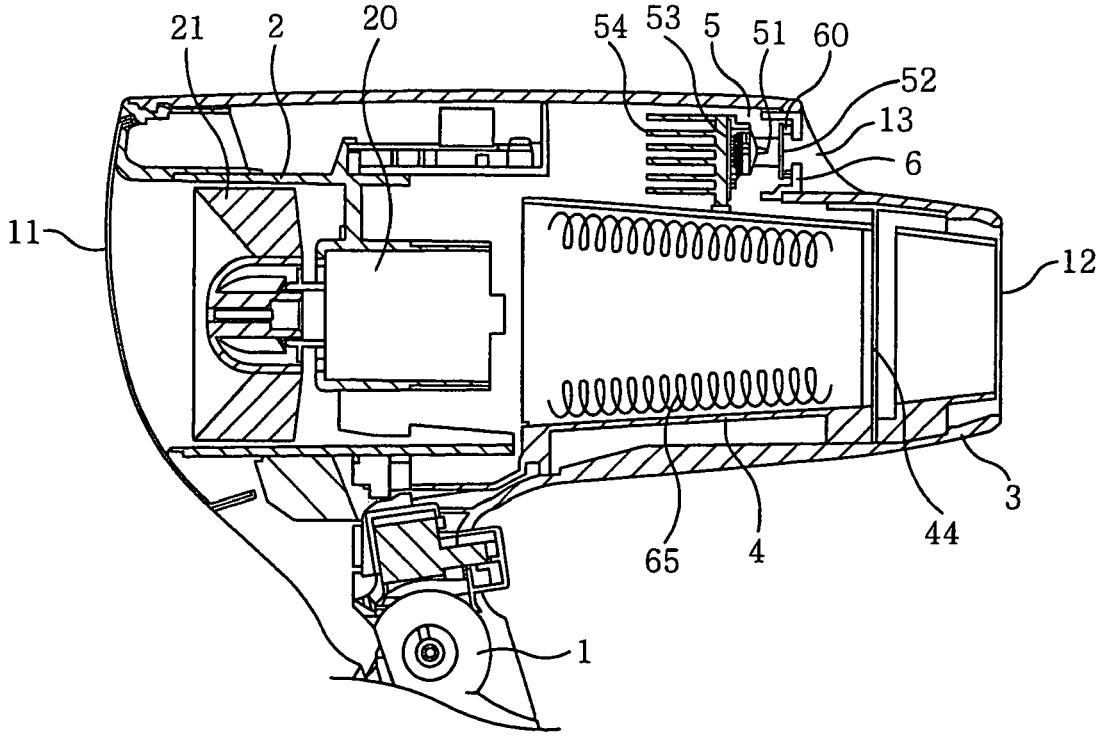
FIG. 1 is a cross sectional view showing major parts of a hair dryer in accordance with one embodiment of the present invention.
Figure 2:
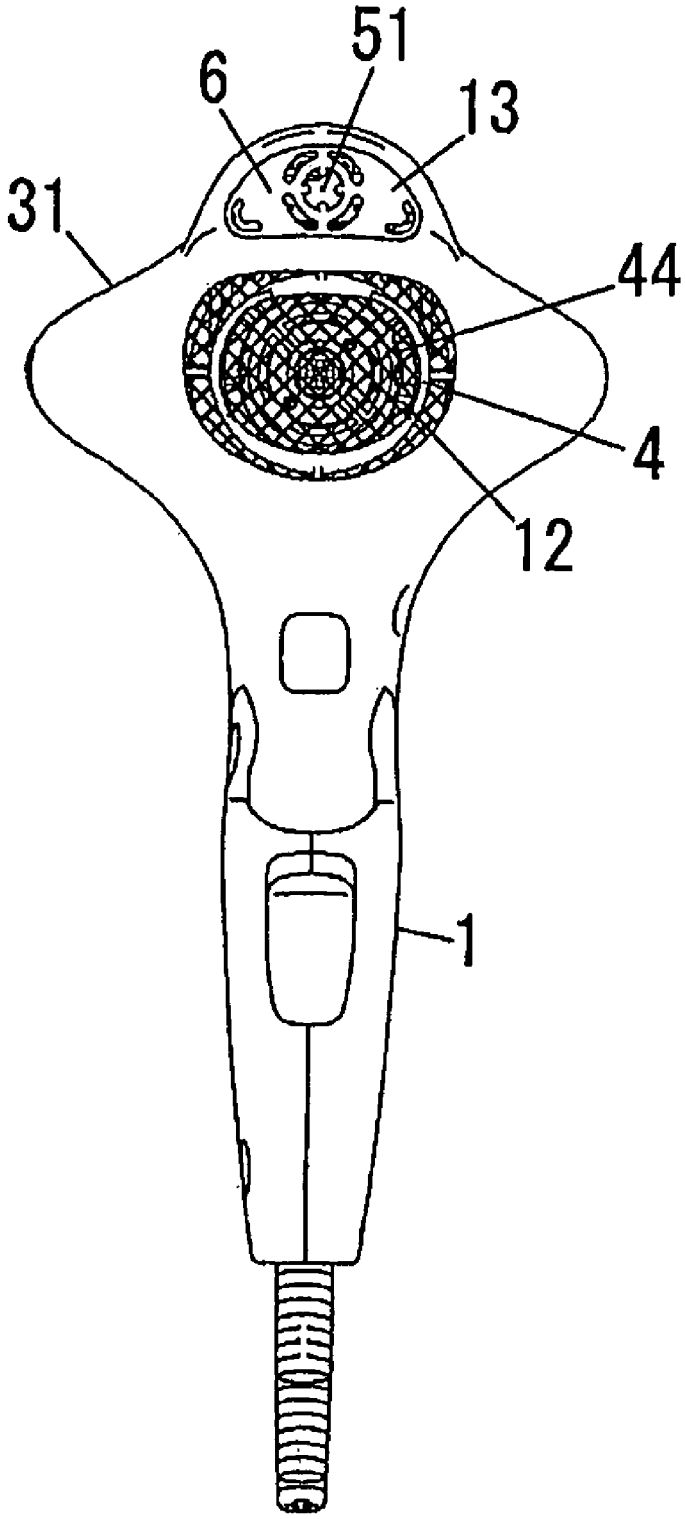
FIG. 2 is a front elevational view illustrating the hair dryer in accordance with the embodiment of the present invention.
Figure 3:
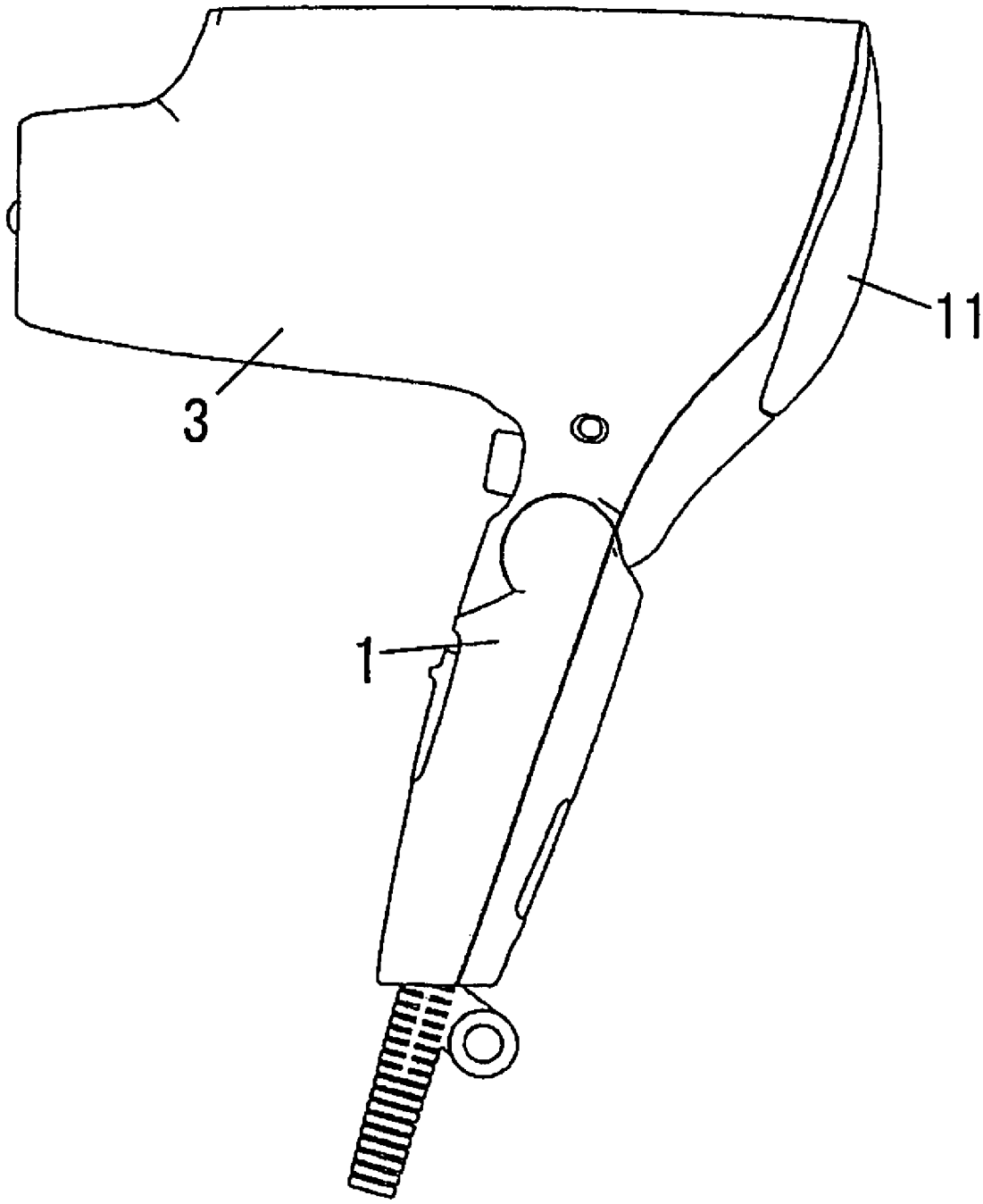
FIG. 3 is a side elevational view illustrating the hair dryer in accordance with the embodiment of the present invention.

Referring to FIGS. 1 to 3, a hair dryer which illustrates an example of a heating and blowing apparatus in accordance with an embodiment of the present invention includes a cylindrical main body housing 3 having an inlet port 11 at its rear end and a discharge port 12 at its front end. A grip portion 1 is connected to a rear bottom surface of the main body housing 3.

The main body housing 3 includes a rear wind tunnel 2 in which a motor 20 and a fan 21 are placed and a front wind tunnel 4 in which a heater 65 is arranged. The front wind tunnel 4 is set within the main body housing 3 in a state that an annular air flow path is provided between the front wind tunnel 4 and an inner circumferential surface of the main body housing 3. The front wind tunnel 4 is integrally formed with the rear wind tunnel 2.

Most of the wind from the fan 21 moves through the front wind tunnel 4 toward the discharge port 12, and the rest of the wind flows toward the discharge port 12 through the air flow path formed between the front wind tunnel 4 and the inner circumferential surface of the main body housing 3. This is to ensure that a cold air, which detours the heater 65, can be discharged from the discharge port 12 in such a way as to surround a heated air from the heater 65, thereby preventing the hair of a user from being overheated. In the drawings, the reference numeral "44" designates a grating disposed in a front portion of the front wind tunnel 4 to keep fingers from touching the heater 65.

An ion generator 5 is arranged in an upper part of the main body housing 3. The ion generator 5 illustrated in the drawings has a function of electrostatic atomization and includes a needle-shaped discharge electrode 51, a ring-shaped opposing electrode 52, a cooler 53 for cooling the discharge electrode 51 to condense moisture in the air into water on the discharge electrode 51 formed of a Peltier device, and a radiator 54 for dissipating the heat generated from the cooler 53. The discharge electrode 51 is connected to a high voltage generator (not shown) and the opposing electrode 52 is grounded.

If the high voltage generator applies a negative high voltage to the discharge electrode 51 cooled by the cooler 53, an electric discharge occurs between the discharge electrode 51 and the opposing electrode 52. Then, the water condensed on the discharge electrode 51 is subject to Rayleigh distribution and thus turned to negatively electrified fine water particles which, in turn, are discharged to the outside from an ion emission port 13 formed in an upper front portion of the main body housing 3. As described, a part of the wind generated by the fan 21 is introduced into the space in which the ion generator 5 lies to cool the radiator 54, and is partly discharged from the ion emission port 13, in which process the ions (electrified fine water particles) are air-borne to the outside.

A cover 6 for preventing fingers from entering into the interior space is arranged at the ion emission port 13. As illustrated in FIG. 2, the cover 6, which is made of an insulating material, has an opening through which the ions (electrified water particles) are allowed to pass. The cover 6 is provided with a plurality of integrally formed protrusions 60 projecting rearwardly, i.e., toward the ion generator 5. The protrusions 60 are in contact with a front surface of the opposing electrode 52 of the ion generator 5. Thus, the cover 6 is grounded through the opposing electrode 52.

This prevents the cover 6 from being electrified to impede emission of the ions, when the ions (electrified water particles) generated by the ion generator 5 are discharged from the ion emission port 13 through the opening.

The opposing electrode 52 is of a ring shape and has a circular opening at the center thereof. An electrical discharge occurs between the discharge electrode 51 and an inner circumferential edge of the opposing electrode 52. The plurality of protrusions 60 of the cover 6 are provided at an equal interval in a circumferential direction to make contact with portions of the opposing electrode 52 close to the inner circumferential edge thereof. Furthermore, the protrusions 60 are formed near an edge of the opening of the cover 6 to further eliminate any electrical influence on the ions passing through the opening of the cover 6.

Figure 4:
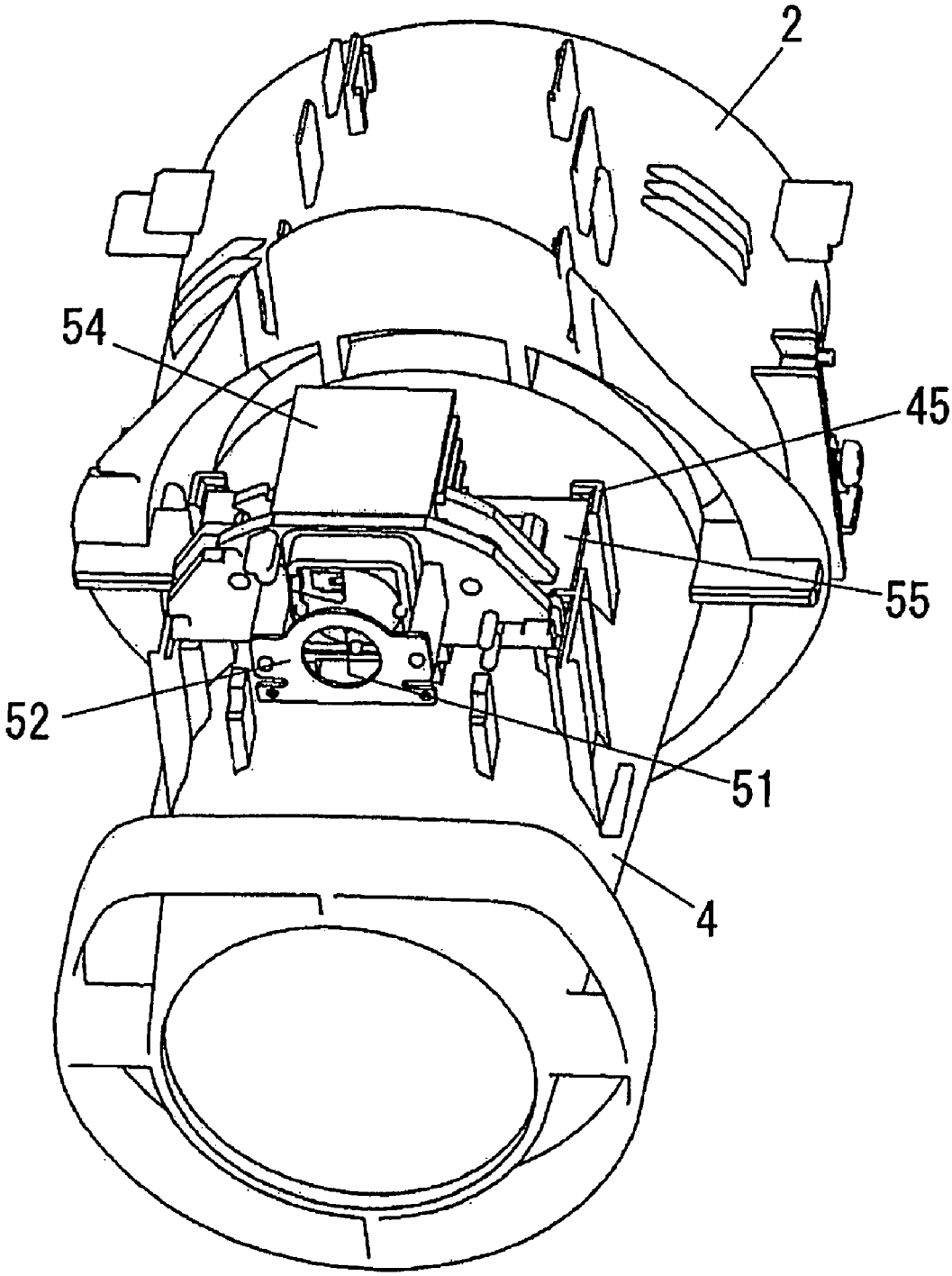
FIG. 4 is a perspective view depicting a wind tunnel and an ion generator of the hair dryer in accordance with the embodiment of the present invention.

In order to assure a stable contact between the protrusions 60 and the opposing electrode 52, the ion generator 5 is attached by being pressed against the cover 6. That is, as shown in FIG. 4, the ion generator 5 is attached to an outer surface of the front wind tunnel 4 through a mounting plate 55. The mounting plate 55 rests against an end portion of each rib 45 integrally formed on the outer surface of the front wind tunnel 4, whereby backward movement of the mounting plate 55 is restrained by the ribs 45. When the cover 6 and the ion generator 5 are assembled, the ribs 45 are adapted to press the mounting plate 55 in a forward direction. Thus, the ribs 45 and the mounting plate 55 are bent to ensure that a forward biasing force is exerted against the protrusions 60 of the cover 6 by the opposing electrode 52, thereby increasing a contact pressure therebetween.

Figure 5:
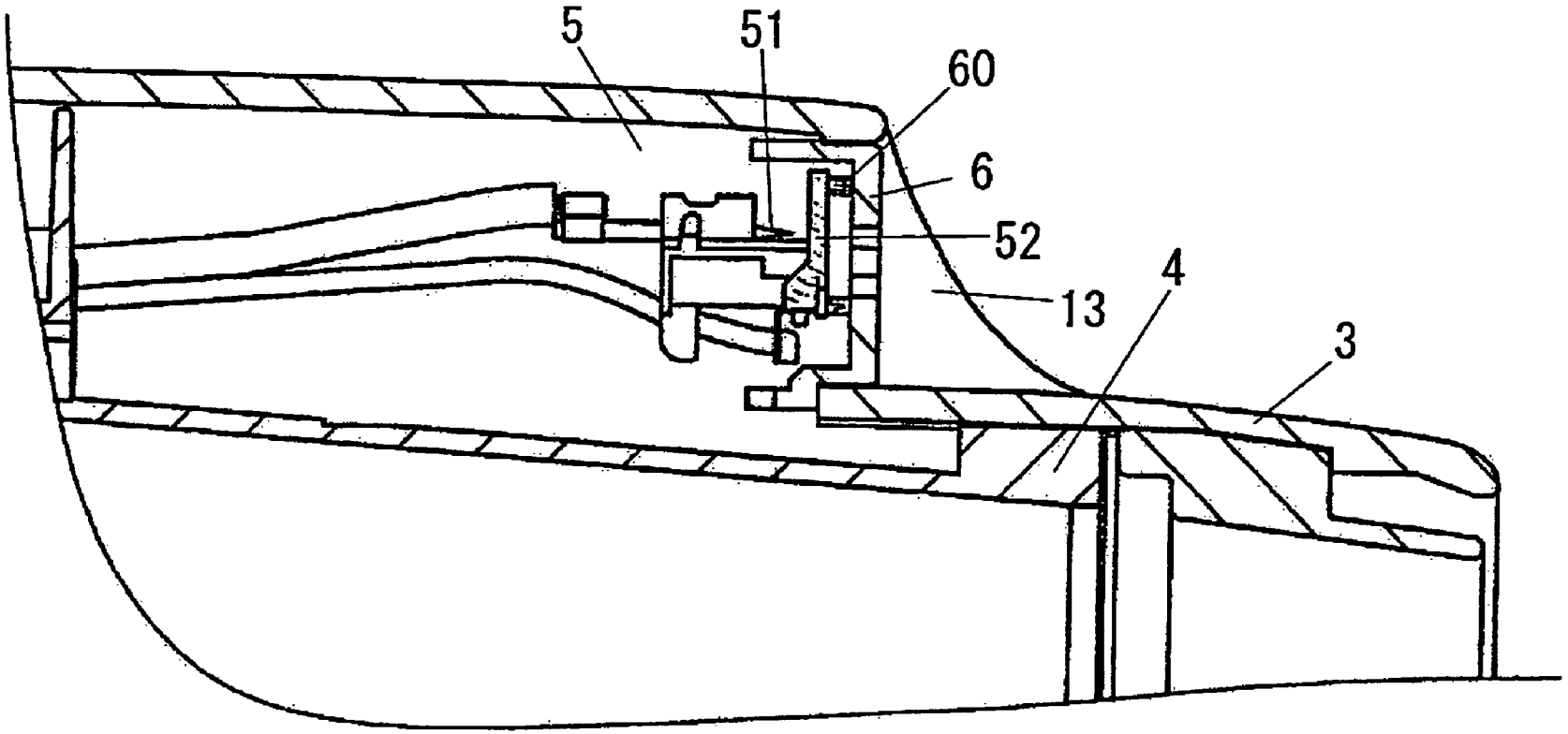
FIG. 5 is a partial cross section view showing a hair dryer in accordance with another embodiment of the present invention.

FIG. 5 shows a hair dryer in accordance with another embodiment of the present invention. The hair dryer of this embodiment is provided with an ion generator 5 that includes the discharge electrode 51, the opposing electrode 52 and the high voltage generator, but has no electrostatic atomization function. This embodiment is the same as the foregoing embodiment in that the cover 6 is grounded through the opposing electrode 52 by bringing the protrusions 60 on the rear surface of the cover 6 into contact with the opposing electrode 52.

While the invention has been shown and described with respect to the embodiment, it will be understood by those skilled in the art that various changes and modifications may be made without departing from the spirit and scope of the invention as defined in the following claims.

What is claimed is:

1. A heating and blowing apparatus comprising:

a main body housing having an inlet port and a discharge port;

a rotatingly driven fan and a heating unit arranged on an air flow path, the air flow path extending from the inlet port to the discharge port;

an ion generator including a discharge electrode and an opposing electrode arranged in a bypass flow path, the bypass flow path branching off from the air flow path and leading to an ion emission port; and a cover arranged at the ion emission port, the cover having an opening through which ions pass and one or more protrusions provided on a rear surface of the cover, the protrusion making contact with the opposing electrode placed closer to the cover than the discharge electrode is, wherein the cover is grounded through the opposing electrode.

2. The heating and blowing apparatus of 1, further comprising a biasing unit for pressing the ion generator toward the protrusions of the cover.

3. The heating and blowing apparatus of 1, wherein the opposing electrode is ring-shaped and the protrusions of the cover are provided in a circumferential direction of the opening for contacting portions of the opposing electrode adjacent an inner circumferential edge of the opposing electrode.

4. The heating and blowing apparatus of 1, wherein the ion generator includes a cooler for cooling the discharge electrode so as to condense moisture in air into water on the discharge electrode.

5. The heating and blowing apparatus of 1, wherein the cover is made of an insulating material.

6. The heating and blowing apparatus of 4, wherein the cooler is a Peltier device.

* * * * *